US007320620B2

(12) United States Patent
Ege et al.

(10) Patent No.: US 7,320,620 B2
(45) Date of Patent: Jan. 22, 2008

(54) ELECTRICAL NETWORK-POWERED HAND-HELD POWER TOOL

(75) Inventors: Manfred Ege, Huglfing (DE); Helmut Burger, Moorenweis (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/601,032

(22) Filed: Nov. 17, 2006

(65) Prior Publication Data

US 2007/0117477 A1 May 24, 2007

(30) Foreign Application Priority Data

Nov. 21, 2005 (DE) ..... 10 2005 000 162

(51) Int. Cl.
*H01R 13/60* (2006.01)

(52) U.S. Cl. ..... 439/568; 439/131; 310/50

(58) Field of Classification Search ..... 439/892, 439/527, 529, 568; 310/50
See application file for complete search history.

(56) References Cited

U.S. PATENT DOCUMENTS 442,366 A * 12/1890 Cuneo ..... 238/15
3,843,224 A * 10/1974 Gerke et al. ..... 439/366
5,885,102 A * 3/1999 Harting et al. ..... 439/527
5,893,420 A * 4/1999 Schoeps ..... 173/181
6,099,329 A * 8/2000 Goff et al. ..... 439/131
6,443,753 B1 * 9/2002 Bludis et al. ..... 439/373
6,579,108 B1 * 6/2003 Goff ..... 439/131
6,712,637 B2 * 3/2004 Rosa et al. ..... 439/373
6,843,667 B2 * 1/2005 Khoury ..... 439/131
6,872,086 B2 * 3/2005 Milan ..... 439/131

* cited by examiner

*Primary Examiner*—Tho D. Ta
*Assistant Examiner*—Vanessa Girardi
(74) *Attorney, Agent, or Firm*—Abelman, Frayne & Schwab

(57) ABSTRACT

An electrical network-powered hand-held power tool (2) includes a connection device for connecting the network cable with a power tool cabling and arranged on through-opening (23) through which a network cable (6) projects, with the connection device (14) having electrical connection elements (24) with which the network cable (6) is connectable, and securing elements (20) for securing the network cable (6), and with the electrical connection elements (24) and the securing elements (20) being at least partially displaceable out of an interior (42) of the housing (4) through a mounting opening (40) of the housing (4) upon lifting of the mounting cover (18) off the mounting opening (40).

9 Claims, 5 Drawing Sheets

ELECTRICAL NETWORK-POWERED HAND-HELD POWER TOOL

BACKGROUND OF THE INVENTION

1. Field of the Invention

The present invention relates to an electrical network-powered hand-held power tool such as, in particular, a hammer drill, a chisel or percussion drilling tool, a motor-driven saw such as, in particular, compass or saber saw, a cutting tool, or a grinding tool, in particular an angle grinding tool. The hand-held power tool includes a housing from which a network cable projects for connection with the electrical network, and a connection device that is arranged on the through-opening through which the network cable extends, and that connects the network cable with the hand-held power tool cabling. The connection device has electrical connection means with which the network cable is connectable, and securing means for securing the network cable. The housing has a mounting opening which is closed with a mounting cover. Upon lifting of the mounting cover, displacing it away from the housing, the connection device becomes accessible for repair purposes or for replacing the network cable.

2. Description of the Prior Art

With such hand-held power tools, an expensive disassembly of the housing for replacing the network cable is avoided. Rather, the mounting cover needs to be simply removed from the housing in order to separate or to establish electrical and mechanical connections of the connection device.

German Publication DE 100 05 989 A1 discloses a hand-held power tool in which a specific service cover is provided in the region of a through-opening through which a network cable extends. The service cover can be unscrewed from the housing. Thereby, the through-opening region in which electrical connection means and securing means are provided and which should be released or connected for replacing the network cable, is exposed.

With a known construction of a power tool, it is possible, by only removing the service cover, to make accessible the mounting region that is relevant for replacing or servicing the network cable. Otherwise, the housing can remain closed.

The drawback of the known hand-held power tool consists in that the service cover should be made relatively large in order to provide a convenient access to all of electrical and mechanical connections. On the other hand, the stability of the housing can be noticeably reduced if the service cover is too large.

Accordingly, an object of the present invention is to provide a hand-held power tool in which the drawbacks of the known power tool are eliminated, and a comfortable access to the connection device is possible with a lesser weakening of the housing stability.

SUMMARY OF THE INVENTION

This and other objects of the present invention, which will become apparent hereinafter, are achieved by providing a hand-held power tool in which the electrical connection means and the securing means are at least partially displaceable out of the interior of the housing through the mounting opening. Due to this displacement, with the electrical connection means and securing means being on the outside of the housing, they become essentially freely accessible. The mounting opening should be so designed that the connection means and the securing means which are relevant for mounting and dismounting of the network cable, can be displaced therethrough. It is possible to make the mounting opening very small and, thereby, to maintain an adequate stability of the housing. The free access to the relevant electrical connection means and securing means at the outer side of the housing provides for a particular comfortable mounting, dismounting, and maintenance of the network cable.

According to a particular advantageous embodiment of the invention, the electrical connection means and the securing means are held on the support. The support is displaceable between an operational position in which the electrical connection means and the securing means are located in the interior of the housing and an open position in which the electrical connection means and the securing means are located, at least partially, outside of the interior of the housing. Thereby, a comfortable handling of the connection means is ensured.

Advantageously, the support is connected with the mounting cover. Thereby, by displacing the mounting cover away from the housing, the connection device is displaced therewith. Thereby, the connection device becomes quickly and comfortably accessible.

Advantageously, the through-opening through which the network cable extends is formed in the mounting cover. This provides for securing of the network cable only to the mounting plane, which further facilitate handling.

It is particularly advantageous when the connection device is preloaded to its open position. Thereby, the connection device is automatically brought into its open position upon release of the mounting cover, displacing it away from the housing. However, the connection device remains forcelockingly connected with the hand-held power tool. In this way, a stable position of the connection device in its open position is insured. This again insures a comfortable handling of the power tool.

In a specific advantageous embodiment, the connection device is preloaded by a resiliently elastic sheathing of the power tool cabling. Thereby, no separate spring is required, which reduces manufacturing costs.

Advantageously, the connection device has in its open position, an end stop. This insures, on one hand, that a favorable position of the connection device, in which the connection means and securing means can be particularly easily accessed, can be predetermined. On the other hand, the mounting cover is still retained on the hand-held power tool in its open position, which prevents the mounting cover from being lost.

It is advantageous when the end stop is formed by the protective sheathing. In this way, there is no need in a separate end stop. This again reduces manufacturing costs.

Advantageously, the support has guide means that cooperates with counter-guide means secured on the housing to provide for a translational movement of the support relative to the housing. Thereby, a drawer-like guide of the support and, thereby, of the connection device is provided. This ensures a comfortable displacement of the support between its operational and open positions, with the connection device being stably retained relative to the housing in both positions. This insures both comfortable mounting and dismounting of the network cable and a reliable operation of the power tool.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiment, when read with reference to the accompanying drawings.

DETAILED DESCRIPTION OF THE PREFERRED EMBODIMENTS

Figure 1:
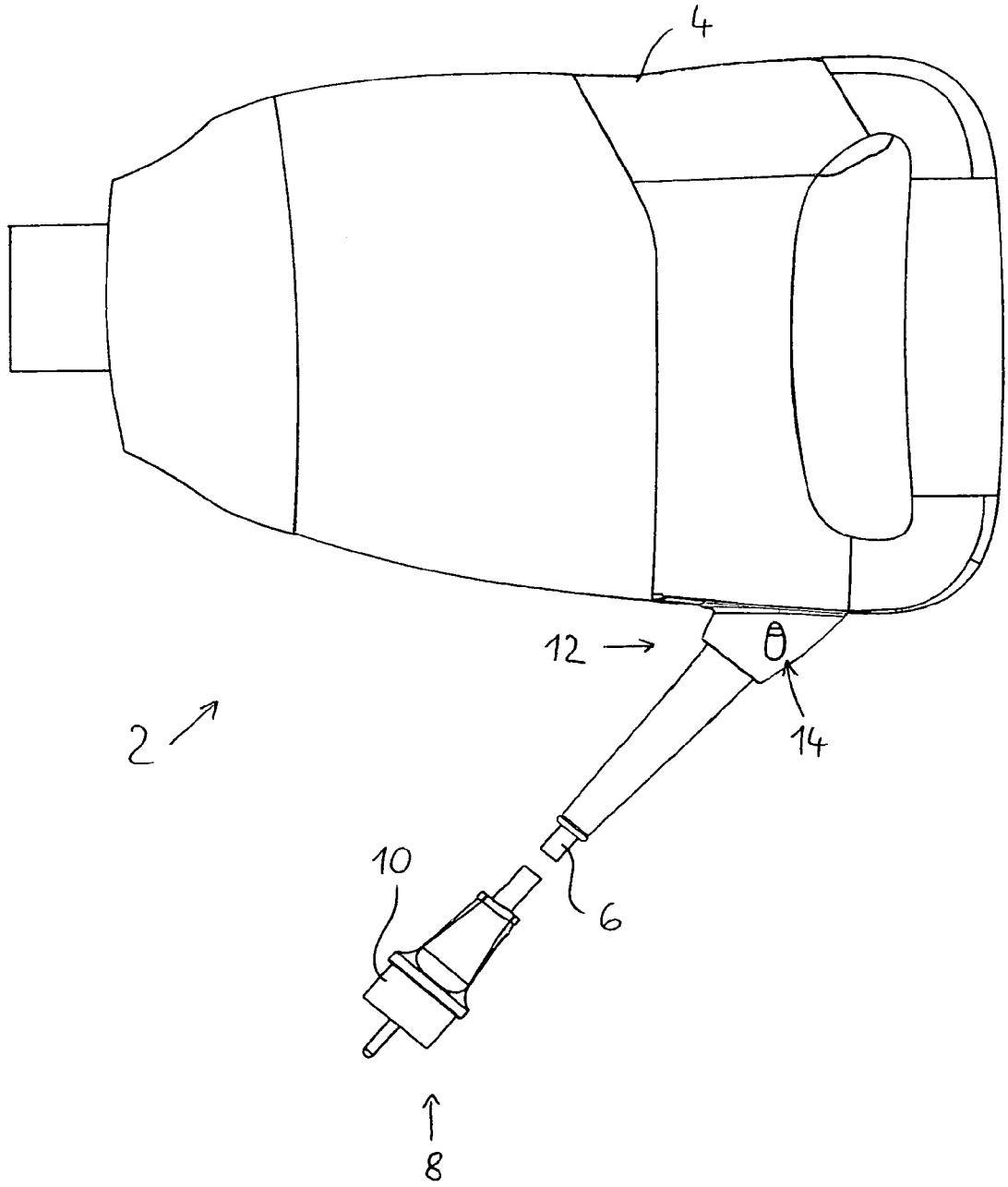
FIG. 1 a schematic view of a hand-held power tool according to the present invention in an operational position thereof.

An electrical-powered network hand-held power tool 2, which is shown in FIG. 1, is formed as a chisel power tool having a housing 4. For supplying power to the power tool 2, there is provided a network cable 6 secured to the power tool. The free end of the net work cable 6 is connected with a mains plug 11 at the power tool-side end 12, the network cable 6 is connected with connection device 14.

Figure 2:
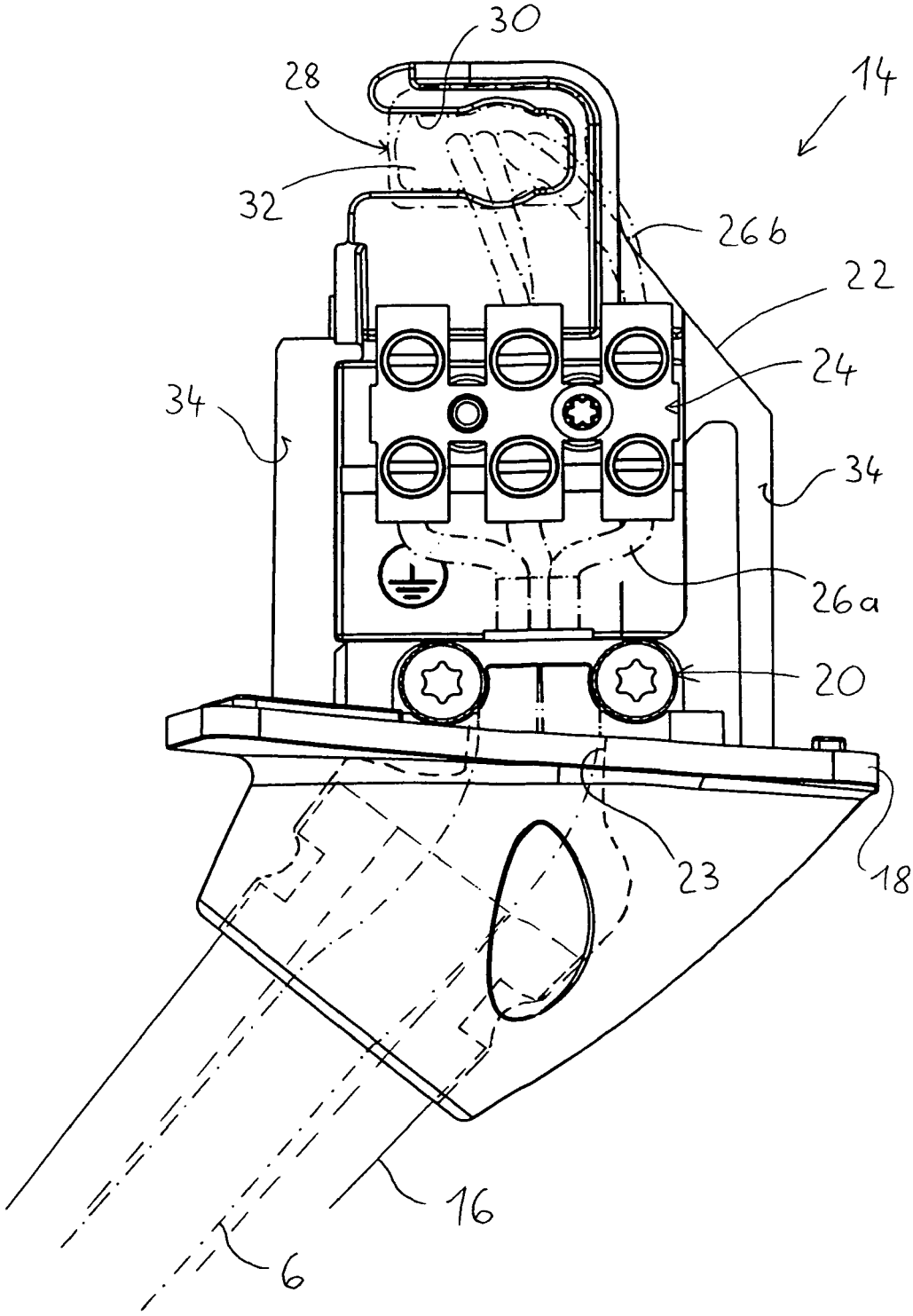
FIG. 2 a simplified view of a connection device of the power tool shown in FIG. 1.

As particularly shown in FIG. 2, the connection device 14 has a socket 16 for securing the network cable 6. The socket 16 is connected with a mounting cover 18 and envelopes a section of the network cable 6. The socket 16 further includes securing elements 20 which are arranged on a support 22. In the mounting cover is formed a through-opening 23 through which the network cable 6 projects out of the housing 4. The support 22 is connected with the mounting cover 18 at a side of the mounting cover 18 remote from the socket 16.

On the support 22, there is further provided electrical connection elements 24 in form of luster terminals. The connection elements 24 connect the cable strands 26*a* of the network cable 6 with the power tool strands 26 of the power tool cabling 28. On the support 22, there is further provided a terminal receptacle 30 in which a protective sheathing 32 of the power tool cabling 28 can be secured.

Figure 3:
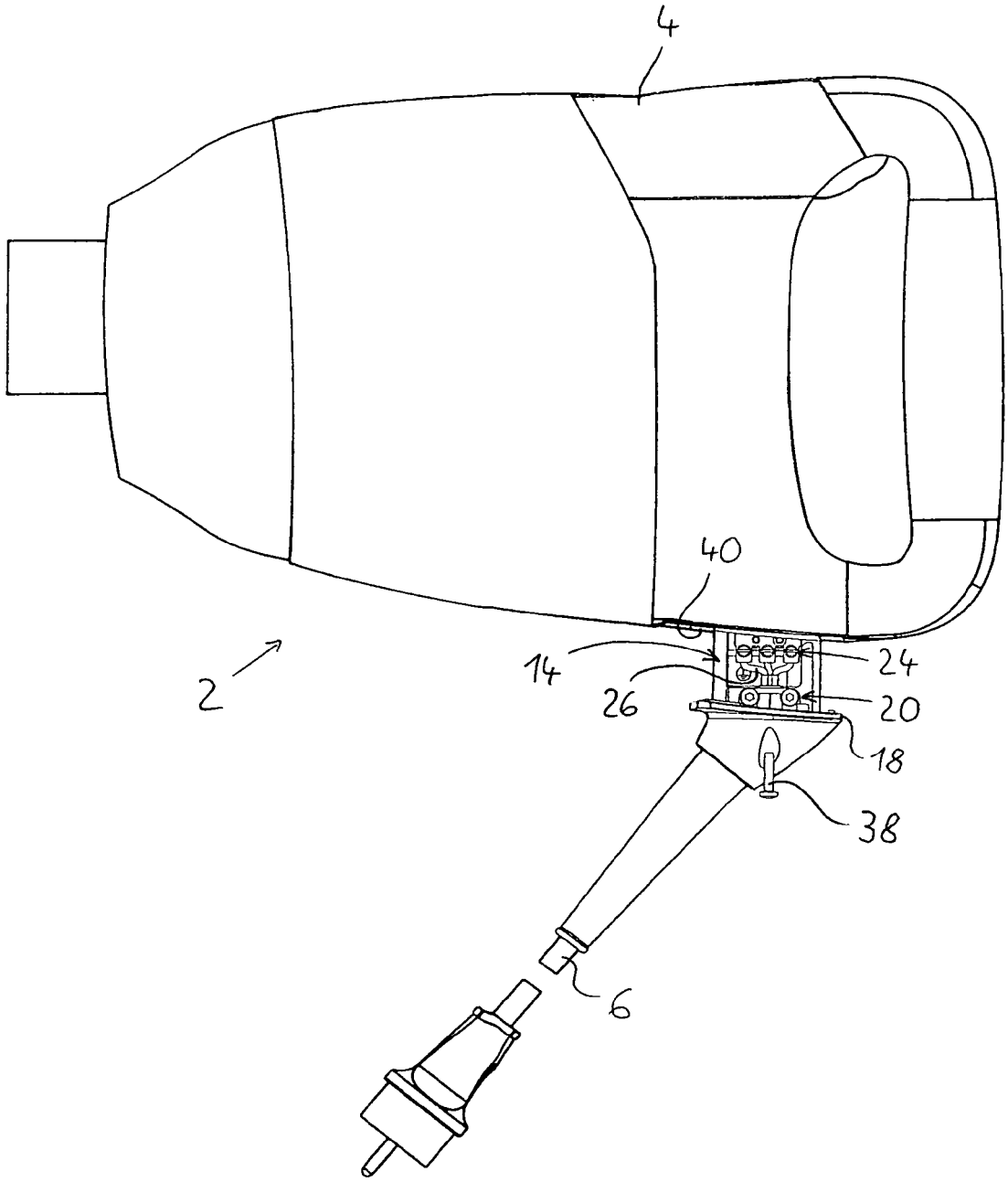
FIG. 3 a schematic view of the power tool shown in FIG. 1 with an open mounting cover.

In addition, on the support 22, there is provided guide means 34 that cooperates with groove-shaped counter-guide means 36 (please see FIG. 4) of the housing 4, providing for translational movement of the support 22 together with the connection device 14 relative to the housing 4. The guide means 34 can be formed by rims of the support 22, as shown, or alternatively, by ribs provided thereon. Thereby the connection device 14 can be displaced from its operational position, shown in FIG. 1, away form the housing 4 into open position shown in FIGS. 3 and 4 upon releasing two fastening screws 38 which secure the connection device 14 to the housing 4. Thereby the mounting cover 18 is lifted off the mounting opening 40 of the housing 4 so that the support 22 can be displaced from the interior 42 of the housing 4 through the mounting opening 40 outwardly.

In the open position, the securing elements 20 and at least the sides of the connection elements 24 with which the cable strands 26*a* are connected, are located outside of the housing 4. Thereby, both mechanical and electrical connections of the network cable 6 with the power tool 2 are easily accessible and can be disconnected or established very easily.

Figure 4:
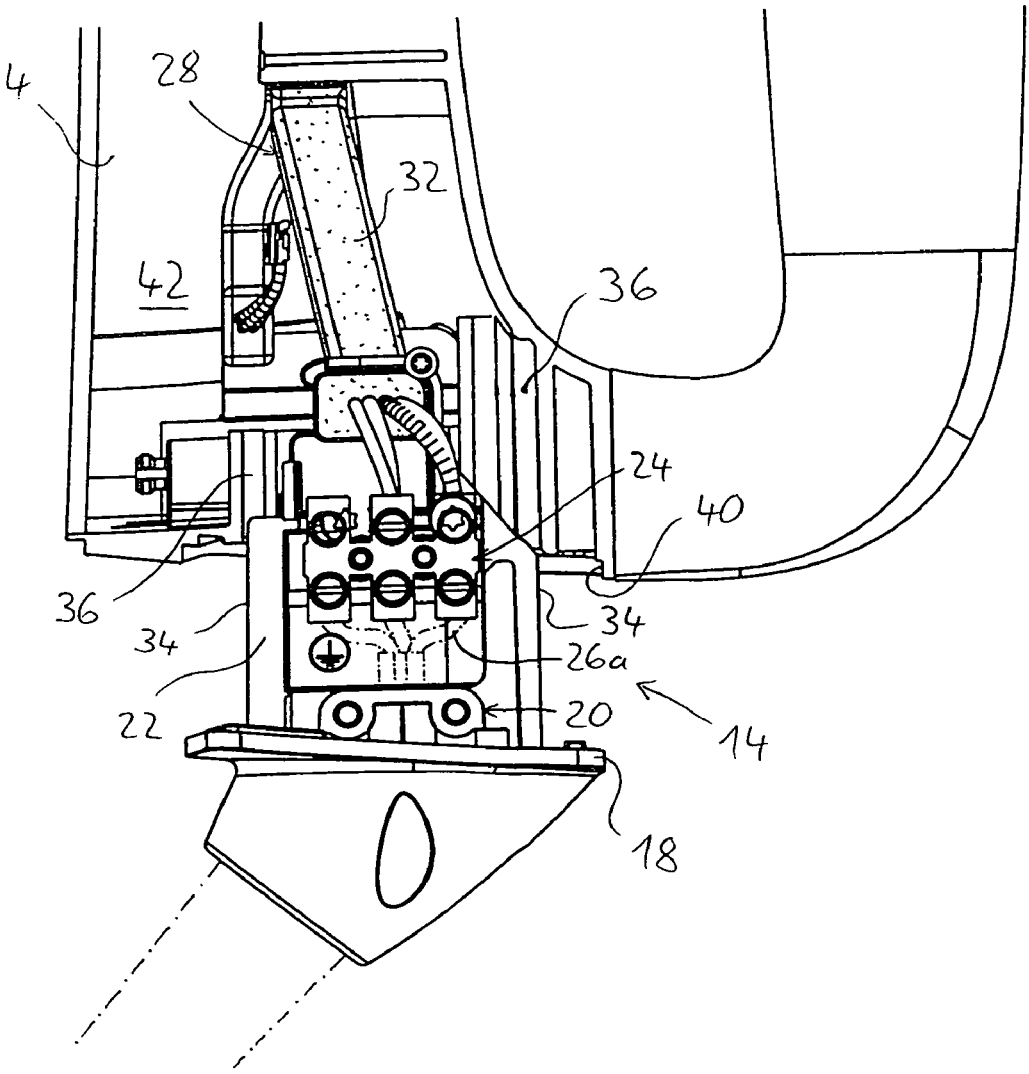
FIG. 4 a front view of the connection device according to FIG. 3 in a mounting condition in an open position.
Figure 5:
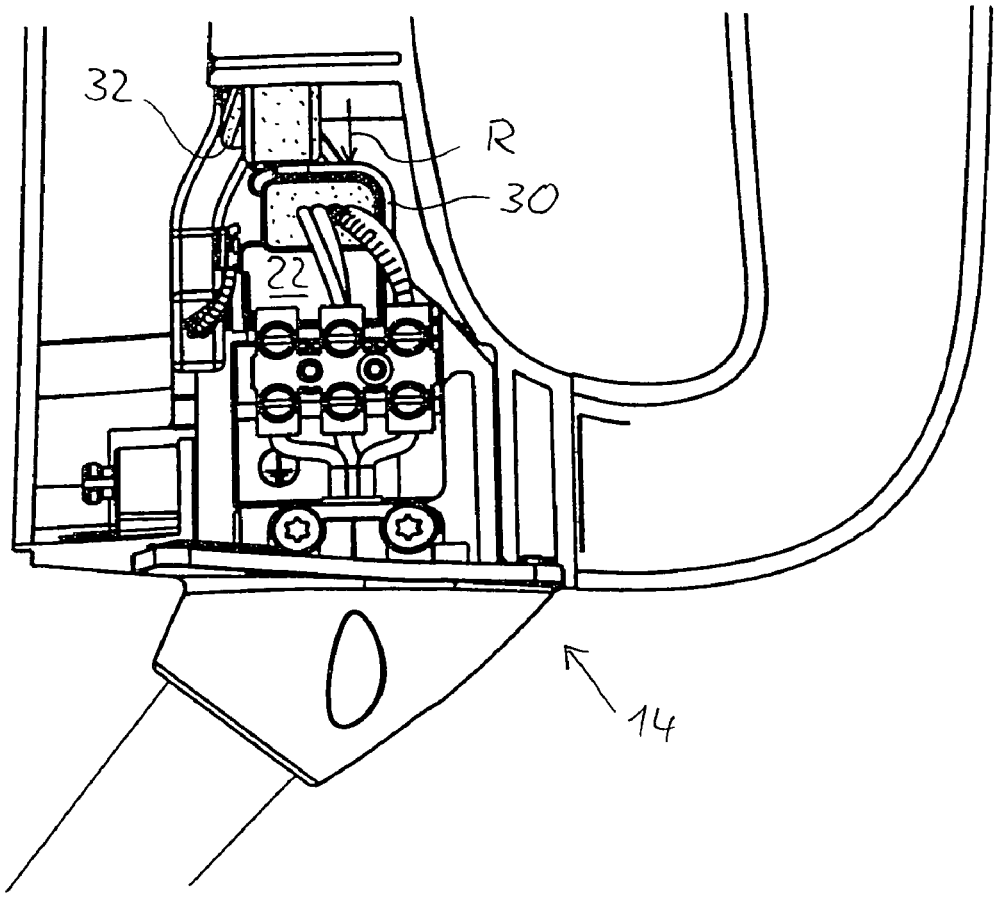
FIG. 5 a front elevational view of the connection device according to FIG. 3 in a mounting condition and in an operational position.

As shown in FIG. 4, in its open position the connection device 14, is held on the housing 4 by the protective sheathing 32 of the power tool cabling 28. When the connection device 14 is brought in its operational position, the protective jacket 32 bends, as shown in FIG. 5. By using a resilient elastic material, with the protective jacket 32, which is supported against the housing 4, a return force R is produced that acts on the terminal receptacle 30 of the support 22 and biases the connection device 14 in a direction of the open position of the connection device 14. Thereby, the connection device 14 is automatically displaced into its open position shown in FIG. 4, upon release of the fastening screws 28. Simultaneously, the length of the protective jacket 32 is so selected that it acts, in the open position of the connection device 14, as a stop, preventing sliding of the guide means 34 away from the counter-guide means 36.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. An electrical network-powered hand-held power tool (2), comprising;

a housing (4) from which a network cable (6) projects through a through-opening (23) for connection with the electrical network and which has a mounting opening (40);

a mounting cover (18) for closing the mounting opening (40), and a connection device (14) for connecting the network cable (6) with a power tool cabling (28) and arranged on the through-opening (23), the connection device (14) having electrical connection means (24) with which the network cable (6) is connectable, and securing means (20) for securing the network cable (6) on the tool, and means for at least partially displacing the electrical connection means (24) and the securing means (2) out of an interior (42) of the housing (4) through the mounting opening (40) upon lifting of the mounting cover (18) off the mounting opening.

2. An electrical network-powered hand-held power tool according to claim 1, wherein the displacing means comprise a support (22), wherein the electrical connection means (24) and the securing means (20) are held on the support (22), and wherein the support (22) is displaceable between an operational position in which the electrical connection means (24) and the securing means (20) are located in the interior (42) of the housing (4), and an open position in which the electrical connection means (24) and the securing means (20) are located, at least partially, outside of the interior (42) of the housing (4).

3. An electrical network-powered hand-held power tool according to claim 2, wherein the support (22) has guide means (34) that cooperates with counter-guide means (36)

secured on the housing (4) to provide for a translational movement of the support (22) relative to the housing (4).

4. An electrical network-powered hand-held power tool according to claim 2, wherein the support (22) is connected with the mounting cover (18).

5. An electrical network-powered hand-held power tool according to claim 4, wherein the through-opening (23) through which the network cable (6) extends is formed in the mounting cover (18).

6. An electrical network-powered hand-held power tool according to claim 2, comprising means for preloading the connection device (14) in an open position thereof.

7. An electrical network-powered hand-held power tool according to claim 6, wherein the preloading means comprises a resiliently elastic protective sheathing (32) of a power tool cabling (28).

8. An electrical network-powered hand-held tool according to claim 6, wherein the connection device (14) has in the open position thereof, an end stop.

9. An electrical network-powered hand-held power tool according to claim 8, wherein the end stop is formed by the protective sheathing (32).

* * * * *